United States Patent [19]

Bricker et al.

[11] Patent Number: 4,992,157

[45] **Date of Patent: * Feb. 12, 1991**

[54] PROCESS FOR IMPROVING THE COLOR AND COLOR STABILITY OF HYDROCARBON FRACTION

[75] Inventors: Jeffery C. Bricker, Buffalo Grove, Ill.; Bryan L. Benedict, Redondo Beach, Calif.; Sheila L. Pollastrini, Bloomingdale, Ill.

[73] Assignee: UOP, Des Plaines, Ill.

[ * ] Notice: The portion of the term of this patent subsequent to Jan. 30, 2007 has been disclaimed.

[21] Appl. No.: 441,869

[22] Filed: Nov. 27, 1989

Related U.S. Application Data

[63] Continuation-in-part of Ser. No. 237,471, Aug. 29, 1988, Pat. No. 4,897,175.

[51] Int. Cl.[5] ..... C10G 17/00; C10G 45/00

[52] U.S. Cl. ..... 208/12; 208/142; 208/143; 208/145; 208/263

[58] Field of Search ..... 208/12, 143, 145, 263

[56] References Cited

U.S. PATENT DOCUMENTS 4,897,175 1/1990 Bricker ..... 208/12

*Primary Examiner*—Helane E. Myers

*Attorney, Agent, or Firm*—Thomas K. McBride; Eugene I. Snyder; Frank S. Molinaro

[57] ABSTRACT

This invention relates to a process for improving the color and color stability of a hydrocarbon fraction. The process involves contacting the hydrocarbon fraction with a selective hydrogenation catalyst in the presence of hydrogen at reaction conditions. This results in the selective hydrogenation of conjugated unsaturates, thereby improving the color and color stability of the hydrocarbon fraction. The process uses small quantities of hydrogen and is run under mild conditions. A preferred selective hydrogenation catalyst is sulfided nickel on an alumina/clay support.

10 Claims, No Drawings

PROCESS FOR IMPROVING THE COLOR AND COLOR STABILITY OF HYDROCARBON FRACTION

CROSS-REFERENCE TO RELATED APPLICATIONS

This application is a continuation-in-part of our copending application, Ser. No. 237,471, filed Aug. 29, 1988 now U.S. Pat. No. 4,897,175.

BACKGROUND OF THE INVENTION

This invention relates to a process for the improvement of the color and color stability of a hydrocarbon fraction. In one aspect, this invention relates to a catalytic selective hydrogenation treatment of a hydrocarbon fraction to render the hydrocarbon fraction color stable.

The improvement of color stability of a hydrocarbon fraction (and kerosene in particular) is desirable because it increases the marketability of the hydrocarbon fraction. For example, kerosene used as a carrier for insecticides and similar materials should be substantially colorless and color-stable in order to avoid staining materials with which it may come in contact. When kerosene or other hydrocarbon fractions are used as jet fuel, thinners or vehicles for paints or coatings, color stability is also very desirable.

There are several methods known in the art to improve both the color and color stability of hydrocarbon fractions in general and kerosene in particular. For example, a hydrocarbon fraction may be processed through an adsorbent (usually a clay) to remove the color bodies. However, because clays are very expensive, this type of treating process is rarely used. Another method is hydrogenation as shown in U.S. Pat. No. 2,793,986 which discloses treating kerosene at a temperature of 500° to 650° F. at a pressure of 100 to 250 p.s.i. and a hydrogen flow of 1,000 to 5,000 cubic feet per barrel of kerosene treated. The treatment is conducted in the presence of a molybdenum oxide/silica/alumina catalyst. These conditions are extremely severe and not only hydrogenate the color bodies, but would also hydrogenate olefins, aromatics and nitrogen and sulfur compounds (to ammonia and hydrogen sulfide respectively). This is usually referred to as hydrotreating.

The disadvantages to hydrotreating are that it costs about 50 cents to one dollar per barrel to run, it alters the major components of the fraction, and it consumes large quantities of hydrogen. Therefore, there is a need for a process which would render a hydrocarbon fraction color stable but does not cost as much to operate, consume large quantities of hydrogen, or alter the major components of the hydrocarbon fraction.

Applicants have discovered a process that fills this need. Applicants' process is a selective hydrogenation process. Thus, applicants' process uses only about 0.1 to 2 cubic feet of hydrogen per barrel of kerosene versus 1,000 to 5,000 cubic feet per barrel required by the '986 patent. According to the '986 patent, pressures below 100 p.s.i. result in improved color only in the case of untreated kerosenes already having extremely high color. Applicants have found that any type of kerosene can be treated at pressures below 100 psi. The instant invention can be run at a temperature as low as 25° C. whereas the lowest temperature at which the '986 process can be run is 260° C.

Applicants' process also does not alter the major components of the hydrocarbon fraction. This is evidenced by the fact that the amount of aromatics present in the hydrocarbon fraction is substantially the same before and after treating. Thus, only the color bodies and color body precursors are being hydrogenated. The instant process represents a significant advance in the art of rendering hydrocarbon fractions color stable.

SUMMARY OF THE INVENTION

This invention relates to a process for improving the color and color stability of a hydrocarbon fraction containing color bodies and color body precursors comprising contacting the hydrocarbon fraction with a selective hydrogenation catalyst in the presence of hydrogen, at reaction conditions and for a time sufficient to hydrogenate the color bodies and color body precursors, thereby providing a color stable hydrocarbon fraction.

Thus, one specific embodiment comprises contacting kerosene with a platinum on carbon catalyst in a batch reactor at a temperature of about 50° C., 13.6 atmospheres of hydrogen, thereby selectively hydrogenating the color body precursors and color bodies.

A particularly preferred embodiment comprises contacting kerosene with a catalyst containing sulfided nickel dispersed on an alumina/attapulgite clay support at a temperature of about 180° C., 100 psig and 1.7 cubic feet hydrogen per barrel of kerosene, thereby selectively hydrogenating the color body precursors and color bodies.

This and other objects and embodiments will become more apparent after a more detailed description of the invention.

DETAILED DESCRIPTION OF THE INVENTION

As heretofore stated, this invention relates to a process for improving the color and color stability of a hydrocarbon fraction. The types of hydrocarbon fractions which may be treated using this process generally have a boiling point in the range of about 40° to about 325° C. Specific examples of these fractions are kerosene, straight run gasoline, straight run naphthas, heavy gas oils, jet fuels, diesel fuel, cracked gasoline and lubricating oils.

An essential part of the instant process is to contact the hydrocarbon fraction with a selective hydrogenation catalyst. The selective hydrogenation catalyst may be selected from well known selective hydrogenation catalyst. For example, Group VIII metals of the Periodic Table dispersed on a porous support are known to be good selective hydrogenation catalysts. The Group VIII metals are iron, cobalt, nickel, ruthenium, rhodium, palladium, osmium, iridium and platinum. Group VIII metals which are particularly effective for the instant process are ruthenium, platinum, iron, palladium and nickel, with nickel being especially preferred.

The porous support on which the desired metal is dispersed may be selected from the group consisting of aluminas, silica, carbon, alumina-silicates, natural and synthetic molecular sieves, synthetic and natural clays, alkaline earth oxides, e.g., CaO, MgO, etc. and mixtures thereof, with aluminas, molecular sieves and clays being preferred. Illustrative of the clays which can be used are smectite, bentonite, vermiculite, attapulgite, kaolinite, montmorillonite, hectorite, chlorite and beidellite. Of these, a preferred group of clays is attapulgite, bentonite, kaolinite and montmorillonite. Illustrative of the molecular sieves which can be used are zeolite Y, zeolite mordenite, zeolite L and zeolite ZSM-5. A preferred support is a mixture of alumina and clay with an especially preferred support being alumina and attapulgite clay. If an alumina/clay mixture is used, it is preferred that the clay be present in an amount from about 2 to about 60 weight percent. The porous support should have a surface area of about 3 to about 1200 $m^2/g$ and preferably from about 100 to about 1,000 $m^2/g$ and a pore volume of about 0.1 to about 1.5 cc/g, and preferably from about 0.3 to about 1.0 cc/g. The porous support may be formed in any shape which exposes the metal to the hydrocarbon fraction. Particulate shape is usually used for convenience. In particular, the support may be in the shape of pellets, spheres, extrudates, irregular shaped granules, etc.

The Group VIII metal may be dispersed on the porous support in any manner well known in the art such as impregnation with a solution of a Group VIII metal compound. The solution may be an aqueous solution or an organic solvent may be used, with an aqueous solution being preferred. Illustrative of the metal compounds which may be used to disperse the desired metals are chloroplatinic acid, ammonium chloroplatinate, hydroxy disulfite platinum (II) acid, bromoplatinic acid, platinum tetrachloride hydrate, dinitrodiamino platinum, sodium tetranitroplatinate, ruthenium tetrachloride, ruthenium nitrosyl chloride, hexachlororuthenate, hexaammineruthenium chloride, iron chloride, iron nitrate, palladium sulfate, palladium acetate, chloropalladic acid, palladium chloride, palladium nitrate, diamminepalladium hydroxide, tetraamminepalladium chloride, nickel chloride, nickel nitrate, nickel acetate, nickel sulfate, cobalt chloride, cobalt nitrate, cobalt acetate, rhodium trichloride, hexaaminerhodium chloride, rhodium carbonylchloride, rhodium nitrate, hexachloroiridate (IV) acid, hexachloroiridate (III) acid, ammonium hexachloroiridate (III), ammonium aquohexachloroiridate (IV), tetraamminedichloroiridate (III) chloride, and osmium trichloride.

The metal compound may be impregnated onto the support by techniques well known in the art such as dipping the support in a solution of the metal compound or spraying the solution onto the support. One preferred method of preparation involves the use of a steam jacketed rotary dryer. The support is immersed in the impregnating solution contained in the dryer and the support is tumbled therein by the rotating motion of the dryer. Evaporation of the solution in contact with the tumbling support is expedited by applying steam to the dryer jacket. Regardless of how the impregnation is carried out, the impregnated support is dried and then heated at a temperature of about 200° to about 450° C. in a nitrogen/10% steam atmosphere for a period of time of about 1 to about 3 hours.

The amount of metal dispersed on the support may vary considerably but generally an amount from about 0.01 to about 20.0 weight percent of the support is adequate to effect the treatment. Specifically when the desired metal is platinum or ruthenium, the amount present is conveniently selected to be from about 0.1 to about 5 weight percent. When the metal is nickel a preferred concentration is from about 0.5 to about 15 weight percent.

A particularly preferred selective hydrogenation catalyst is a sulfided metal (the same Group VIII metals as enumerated above) dispersed on a porous support. The sulfided metal catalyst may be prepared in a number of ways well known in the art. For example, after the metal has been dispersed onto the support, the resultant catalyst can be sulfided by contacting the catalyst with a sulfur containing compound such as hydrogen sulfide, carbon disulfide, mercaptans, disulfides, etc. The conditions under which the catalyst is sulfided include a temperature of about 20° to about 200° C., and a pressure from atmospheric to about 200 psig. The sulfiding may be carried out either in a batch mode or a continuous mode with a continuous mode being preferred. One method of sulfiding a catalyst is to place the catalyst in a reactor and flow a gas stream over the catalyst at a temperature of about 20° to about 200° C. at a pressure from atmospheric to about 200 psig and a gas hourly space velocity of about 500 to about 5000 $hr^{-1}$. The gas stream contains from about 0.1 to about 3% hydrogen sulfide with the remainder of the gas stream being composed of nitrogen, hydrogen, natural gas, methane, carbon dioxide or mixtures thereof. The total amount of sulfur which is deposited on the metal catalyst can vary substantially but is conveniently chosen to be from about 0.01 to about 2 weight percent of the catalyst.

Another method of sulfiding the catalyst involves adding the sulfur in situ during the hydrogenation process. This method involves adding a sulfur containing compound such as those enumerated above to the hydrocarbon fraction prior to contact with the catalyst. The addition may be done continuously or intermittently. When done continuously the concentration of the sulfur containing compound should be from about 1 to about 50 ppm (on a sulfur basis) and preferably from about 5 to about 25 wppm, whereas when the addition is done intermittently the concentration should be from about 100 to about 5000 wppm and preferably from about 500 to about 2500 wppm.

The hydrocarbon fraction is contacted with the selective hydrogenation catalyst in the presence of hydrogen. The hydrogen reacts with the color bodies and color body precursors, thereby hydrogenating them. The color bodies and color body precursors are compounds which are highly conjugated polyunsaturated organic compounds which may also contain polar atoms such as oxygen, sulfur and nitrogen. Examples of color bodies are indoles, quinones, etc. The color body precursors can undergo oxidation reactions to form color bodies that absorb energy in the visible range of the light spectrum. Hydrogenation of these highly conjugated polyunsaturated organic compounds prevents the formation of color bodies. For example, phenols can be oxidized to quinones which are highly colored species. By hydrogenating phenols to cyclohexanols, the formation of quinones is prevented. Additionally, the color bodies themselves are hydrogenated using the instant process, thereby improving the color quality of the hydrocarbon fraction. Quinones can thus be hydrogenated to a less conjugated system with an absorption wavelength at lower energy, i.e., outside the visible range. Therefore, the instant process accomplishes two objectives: 1) it eliminates existing color bodies, thereby instantly improving the color quality of the hydrocarbon fraction and 2) it eliminates color body precursors, thereby improving the color stability of the hydrocarbon fraction.

Because of the low concentration of hydrogen (about 0.1 to about 3 mole percent of hydrocarbon fraction) and the type of catalyst used, the instant process hydrogenates these highly conjugated polyunsaturates instead of olefins which have isolated double bonds. This is evidenced by the fact that only a slight decrease in the bromine number was observed after hydrogenation. The bromine number measures the quantity of olefinic bonds present in the hydrocarbon fraction. Additionally, as will be shown in the examples, the instant process hydrogenates very little, if any, aromatic compounds which are not highly conjugated, e.g., benzene, toluene, xylene, etc., while hydrogenating highly conjugated polyunsaturated components. Thus, the instant process selectively hydrogenates color bodies and color body precursors without affecting the other components of the hydrocarbon fraction.

The conditions under which the selective hydrogenation takes place are as follows. First, it is necessary to contact the hydrocarbon fraction with the catalyst in the presence of hydrogen at elevated temperatures. For convenience, the temperature range may be chosen to be from about 25° to about 250° C. and preferably from about 35° to about 200° C. The process may be carried out at atmospheric pressure although greater than atmospheric pressure is preferred. Thus, a pressure in the range of about 1 to about 15 atmospheres may be used with pressures of 1 to about 10 atmospheres being preferred. Finally, the amount of hydrogen which is added to the hydrocarbon fraction varies from about 0.1 to about 3 mole percent based on the total hydrocarbon fraction and preferably from about 0.25 to about 2.5 mole percent. At the conditions stated for the process, the small amount of hydrogen which is added to the hydrocarbon fraction is substantially and in some cases completely dissolved in the hydrocarbon fraction.

The process may be operated either in a continuous mode or in a batch mode. If a continuous mode is used a liquid hourly space velocity between about 0.1 and about 40 $hr^{-1}$, and preferably from about 0.5 to about 20 $hr^{-1}$ should be used to provide sufficient time for the hydrogen and unsaturated hydrocarbons to react. If a batch process is used, the hydrocarbon fraction, catalyst and hydrogen should be in contact for a time from about 0.1 to about 25 hrs.

The process described above may be employed in several places in the overall process of refining crude oil. Specifically, in the case of kerosene, the instant process may be placed directly after the crude fractionation column or upstream of the sweetening unit or downstream of the hydrocarbon sweetening unit.

It should be emphasized that the instant process is run with the hydrocarbon fraction substantially in the liquid phase. Thus, only enough pressure is applied to substantially dissolve the hydrogen into the hydrocarbon fraction and to maintain the hydrocarbon fraction in the liquid phase. This is in contrast to a conventional hydrotreating process where the hydrogen is substantially in the gas phase.

As will be shown in greater detail in the examples that follow, a hydrocarbon fraction treated according to the instant process shows very little deterioration in color stability during an accelerated test, whereas an untreated hydrocarbon fraction deteriorates substantially (within a few hours) during the same test. This increase in color stability was obtained without an appreciable loss in the amount of aromatics present in the hydrocarbon fraction.

The following examples are presented in order to more fully illustrate the advantages to be derived from the instant invention. It is to be understood that the examples are by way of illustration only and are not intended as an undue limitation on the broad scope of the invention as set forth in the appended claims.

EXAMPLE I

A selective hydrogenation catalyst was prepared by the following method. Into a rotary evaporator there were placed 50 grams of a Norit PKDA carbon support. This support was in the shape of granules of size between 35 to 100 mesh (Tyler screen size) and had a surface area of 700 $m^2/g$. To this support there were added 20 mL of an aqueous solution containing 0.05 g of chloroplatinic acid (2.45 weight percent Pt).

The impregnated support was first rolled in the rotary evaporator for 15 minutes. After this time the evaporator was heated with steam for about 2 hours. Next the impregnated carbon support was dried in an oven for about 2 hours and then heated to 400° C. under a nitrogen atmosphere, held there for 1 hour in the presence of 10% steam/nitrogen and for 30 minutes in the absence of steam, then cooled down to room temperature in nitrogen.

This catalyst was analyzed and found to contain 1.21% platinum. This catalyst was designated catalyst A.

EXAMPLE II

Another selective hydrogenation catalyst was prepared as in Example I with the following modifications. A gamma alumina was used as the support instead of the carbon support and ruthenium nitrosyl chloride was used instead of the chloroplatinic acid.

This catalyst was calculated to contain 1% ruthenium and was designated catalyst B.

EXAMPLE III

A sample of kerosene was selectively hydrogenated according to the following procedure. In an autoclave there were placed 61 mL of kerosene and 4.75 g of catalyst B. The autoclave was heated to 190° C. and hydrogen was added to give a pressure of 200 psig or 13.7 atm. (This corresponds to 0.28 moles of hydrogen). These conditions were maintained for 24 hours.

Table 1 presents the analyses of the kerosene before and after hydrogenation.

TABLE 1

Comparison of Kerosene Components Before and After Hydrogenation

| Component | Untreated Kerosene | Hydrogenated Kerosene |
|---|---|---|
| Total sulfur (wt. %) | 0.26 | 0.16 |
| Total Nitrogen (ppm) | 1.5 | 0.1 |
| Carbonyls (ug/l) | 14 | 8 |
| Phenols (ppm) | 235 | 30 |
| Bromine # (gBr/100 g) | 5.8 | 3.8 |
| FIA Volume (%) | | |
| Aromatic | 21.8 | 21.7 |
| Paraffin & Naphthenes | 78.2 | 78.3 |

The data in Table 1 show that only 0.1% of the aromatics were hydrogenated and there was only a small decrease in the bromine number, indicating that only a small fraction of the olefins were hydrogenated.

EXAMPLE IV

A sample of kerosene was hydrogenated using catalyst A under the following conditions. In an autoclave there were placed 245 mL of kerosene and 20 g of catalyst A. The autoclave was heated to 50° C. and hydrogen was added to give a pressure of 200 psig or 13.7 atm. (This corresponds to 0.195 moles of hydrogen.) These conditions were maintained for 24 hours.

EXAMPLE V

Samples of kerosene that were untreated (sample C) and treated according to Example III (sample D) were evaluated for color stability using the following procedure. The samples were individually heated to 99° C. under an air atmosphere. Periodically the APHA color was determined according to ASTM method D1209. This test method is similar to that recorded in the Standard Methods for the Examination of Water and Waste Water of the American Public Health Association and is often referred to as "APHA" color. In this method the absorbance of the kerosene at 465 nm was measured with a spectrophotometer. This absorbance is proportional to color formation in the kerosene.

Heating the sample to 99° C. greatly accelerates the formation of color bodies. For example, an untreated sample heated at 50° C. for 10 hours has an APHA of 100, whereas one heated at 99° C. for 10 hours has an APHA of 200. After heating at 50° and 99° C. for 40 hours the APHA color was 100 and 470 respectively. Therefore, conducting the tests at 99° C. allowed us to determine color stability in a relatively short time.

The results of this test are presented in Table 2.

TABLE 2

| Color Stability of Untreated and Hydrogenated Kerosene | | | |
|---|---|---|---|
| | APHA COLOR | | |
| Time (Hours) | Sample C Untreated | Sample D Hydrogenated | Sample E Hydrogenated |
| 0 | 75 | — | 15 |
| 10 | 195 | 5 | 11 |
| 20 | 333 | 35 | 10 |

The data clearly show the decrease in the APHA color obtained after hydrogenation and that the color of the hydrogenated sample has not deteriorated substantially after 20 hours at 99° C. In fact the APHA color of the hydrogenated sample after 20 hours of testing is considerably lower than the initial APHA color of the untreated sample (sample C). Therefore, selective hydrogenation according to the instant invention is very effective at improving the color and color stability of a hydrocarbon fraction.

EXAMPLE VI

After sample C was tested as described in Example V for 20 hours, it was hydrogenated according to the procedure of Example III, i.e., using a ruthenium on alumina catalyst and at 190° C. This sample was designated sample E. Sample E was evaluated for its initial color and color stability according to the procedure in Example V. The results of this evaluation are presented in Table 2.

The data in Table 2 shows that after hydrogenation the APHA color decreased from 333 to 15. Further, the color stability of this hydrogenated sample was virtually unchanged after being exposed to a temperature of 99° C. in air for 20 hours. Therefore, the instant process is capable of both hydrogenating color bodies present in the kerosene and hydrogenating color body precursors.

EXAMPLE VII

A sample of untreated kerosene (sample C) and a sample of kerosene treated according to Example IV (sample F) were evaluated according to the procedure of Example V. The results of these evaluations are presented in Table 3.

TABLE 3

| Color Stability of Untreated and Hydrogenated Kerosene | | | |
|---|---|---|---|
| | a APHA COLOR | | |
| Time (Hours) | Sample C (Untreated) | Sample F (Hydrogenated) | Sample G (Blank Carbon) |
| 0 | 75 | 15 | 76 |
| 10 | 195 | 38 | 177 |
| 20 | 333 | 55 | 232 |

The results presented in Table 3 are similar to the results in Table 2. That is, a kerosene sample hydrogenated using a platinum on carbon catalyst has a lower APHA color and although its color does increase after 20 hours at 99° C. in air, the color is still below the initial APHA color of the untreated kerosene. The color stability of the kerosene has been improved significantly.

EXAMPLE VIII

A sample of kerosene was treated according to Example IV using a sample of carbon fines that did not contain platinum. The treated sample (Sample G) was then evaluated by the method described in Example V. The results indicate little improvement in color reduction or color stability for the kerosene treated with carbon supports not containing a Group VIII metal. Therefore, the results recorded in Table 3 illustrate that the color stability obtained in Sample F is not due merely to adsorption of the color bodies or color body precursors onto the carbon.

EXAMPLE IX

A reactor was set up to continuously treat kerosene as follows. Kerosene (same as Example III) and hydrogen were fed into a feed charger. The hydrogen pressure in the feed charger was 35 psig which allowed part of the hydrogen (about 0.1 mole percent of the kerosene feed) to dissolve in the kerosene. The kerosene containing hydrogen was now fed into a reactor (under 100 psig pressure) which contained a catalyst bed of 25 cc. The reactor was heated to 40° C. The catalyst consisted of 1% Pt (calculated) on a carbon support and was prepared as in Example I. Kerosene was flowed over the catalyst bed at a liquid hourly space velocity (LHSV) of 1.

Kerosene was treated at the above conditions for 25 hours. Periodically samples were removed and analyzed for APHA color. The results of these analyses are presented in Table IV.

TABLE 4

| Color Improvement of Kerosene Using a Continuous Process | |
|---|---|
| APHA | Time on Stream (Hrs) |
| 76 | 0 |
| 22 | 5 |
| 20 | 12 |
| 25 | 19 |
| 30 | 24 |

The kerosene was also analyzed for aromatic, paraffin and naphthene content with virtually no difference observed between the untreated and treated kerosenes.

The data presented in Table IV shows that a selective hydrogenation catalyst of the instant invention can be used in a fixed bed (continuous hydrocarbon flow) mode to improve the color of the kerosene. Further, very little deterioration is observed after 25 hours of operation. In fact, kerosene was processed through the above reactor for a total of 130 hours (at various LHSV and pressures, with the last 20 hours at the conditions described above) and the APHA at the end of 130 hours was 29 indicating that the instant catalyst is very stable and effective at improving the color of a hydrocarbon fraction.

EXAMPLE X

A reactor was set up to continuously treat kerosene as follows. Kerosene with an APHA color of 110 and hydrogen were fed to the charger. The hydrogen pressure on the charger was 80 psig which allowed part of the hydrogen (about 0.22 mole percent of the kerosene feed) to dissolve in the kerosene. The kerosene containing hydrogen was then fed to the reactor (under 100 psig pressure) which contained 10 cc of catalyst. The reactor temperature was raised to 180° C. and the kerosene was flowed over the catalyst at a liquid hourly space velocity of 3 $hr^{-1}$.

The catalyst consisted of a support which was a mixture of alumina (obtained from Catapal) and attapulgite clay (85:15 weight percent ratio) having dispersed thereon 10 weight percent nickel. The catalyst was prepared by using the procedure of Example 1 except that nickel nitrate was used to disperse the nickel onto the alumina/clay support. After the catalyst was calcined, it was sulfided in a batch process by placing the catalyst in a container, filling the container with a 10% $H_2S$/90% $N_2$ gas mixture, tightly closing the container and then letting the mixture equilibrate at room temperature for about 4–5 hours. Analysis of the catalyst showed that it contained 0.2 weight percent sulfur.

Kerosene was treated at the above conditions for an extended period of time. Periodically samples were removed and analyzed for APHA color. A portion of each sample was also tested for color stability by heating for 20 hours as described in Example V. These results are presented in Table 5.

TABLE 5

Color Improvement Using a Sulfided Nickel Catalyst

| Time (Hrs) | APHA Color | APHA Color After Aging | Comments |
|---|---|---|---|
| 0 | 110 | 510 | Feedstock |
| 24 | 0 | 4 | |
| 48 | 0 | 8 | |
| 624 | 6 | 24 | |
| 1140 | 16 | 87 | |
| 1404 | 10 | 63 | Prior to $H_2S$ addition |
| 1589 | 9 | 64 | After 1% $H_2S$ addition to hydrogen |

The data indicate that the sulfided catalyst is effective at color removal and stabilization toward further discoloration. Additionally, the data show that addition of $H_2S$ to the process does not adversely affect performance of the catalyst.

Thus, having described the invention in detail, it will be understood by those skilled in the art that certain variations and modifications may be made without departing from the spirit and scope of the invention as defined herein and in the appended claims.

We claim as our invention:

1. A process for improving the color and color stability of a hydrocarbon fraction containing color bodies and color body precursors comprising contacting the hydrocarbon fraction with a selective hydrogenation catalyst, the selective hydrogenation catalyst comprising a sulfided Group VIII metal dispersed on a porous support selected from the group consisting of alumina, silica, carbon, alumina-silicates, natural and synthetic molecular sieves, natural or synthetic clays, alkaline earth oxides and mixtures thereof, in the presence of hydrogen, the hydrogen substantially dissolved in the hydrocarbon fraction and present in a concentration of about 0.1 to about 3 mole percent based on the total hydrocarbon fraction, at a temperature of about 25° to about 250° C. and a pressure of about 1 to about 15 atmospheres for a time sufficient to hydrogenate the color bodies and color body precursors without substantially hydrogenating any olefins and aromatic compounds contained in the hydrocarbon fraction, thereby providing a color stable hydrocarbon fraction.

2. The process of claim 1 where the support is alumina.

3. The process of claim 1 where the support is a clay.

4. The process of claim 3 where the clay is selected from the group consisting of attapulgite, bentonite, kaolinite and montmorillonite.

5. The process of claim 1 where the support is a mixture of an alumina and a clay.

6. The process of claim 1 where the support is a mixture of an alumina and a clay and the sulfided Group VIII metal is sulfided nickel present in a concentration, as the metal, from about 0.5 to about 20 weight percent of the support.

7. The process of claim 1 where the support is alumina and the sulfided Group VIII metal is sulfided nickel present in a concentration, as the metal, from about 0.5 to about 20 weight percent of the support.

8. The process of claim 1 where the support is a molecular sieve selected from the group consisting of zeolite Y, zeolite mordenite, zeolite L and zeolite ZSM-5.

9. The process of claim 1 wherein the process is operated in a continuous mode at a liquid hourly space velocity of about 0.1 to about 40$hr^{-1}$.

10. The process of claim 1 wherein the process is operated in a batch mode and the contact time is from about 0.1 to about 25 hours.

* * * * *